United States Patent [19]

Tankersley

[11] Patent Number: 4,804,191

[45] Date of Patent: Feb. 14, 1989

[54] METHOD OF PLAYING QUAD-RADIAL CHESS

[76] Inventor: Steven E. Tankersley, 212 Hoeppner La. NE., Cullman, Ala. 35055

[21] Appl. No.: 73,057

[22] Filed: Jul. 13, 1987

[51] Int. Cl.[4] ..... A63F 3/02

[52] U.S. Cl. ..... 273/261

[58] Field of Search ..... 273/241, 261

[56] References Cited

U.S. PATENT DOCUMENTS

| | | | |
|---|---|---|---|
| 3,661,391 | 5/1972 | Henshaw | 273/241 |
| 3,917,273 | 11/1975 | Blakewood | 273/261 |
| 4,553,756 | 11/1985 | Linnekin | 273/261 |

FOREIGN PATENT DOCUMENTS

| | | | |
|---|---|---|---|
| 218607 | 2/1910 | Fed. Rep. of Germany | 273/261 |

*Primary Examiner*—Richard C. Pinkham
*Assistant Examiner*—Benjamin Layno

[57] ABSTRACT

A chess game having a circular chess game board and 32 chess pieces. The game board is subdivided into four equally sized quadrants where each quadrant represents an 8×8 chess game board. The quadrants form a pattern of eight concentric rings of spaces. Each group of 16 chess pieces, one group for each player, is initially positioned to occupy the spaces on the two outermost concentric rings. A first group occupies two quadrants and a second group occupies the two other quadrants. The game provides 3 modes of play. Each mode of play requires a different limitation of the movement of chess pieces within the quadrants.

7 Claims, 1 Drawing Sheet

METHOD OF PLAYING QUAD-RADIAL CHESS

BACKGROUND OF THE INVENTION

The Grandfather to the current invention had its roots somewhere in India, about 500 A.D. And was carried to Europe by 1300, probably through Byzantium and the Moors, and, chess as we know it, most likely dates to 15th century Italy and Spain. Then, by the 18th century France was the games center of activity. And not until the 1930's was it popular in Russia. And as it entered the 20th century it evolved, and thus was born the three-level or Tri-level game. This created a new dimension to chess not seen before.

There were many attempts to add new depth to an already captivating game. And the current invention is the latest in that effort. Taking the mind into another dimension. The world of Quad-Radial Chess.

SUMMARY OF THE INVENTION

The game of Quad-Radial Chess is played upon a board that is circular in shape, and it compliments a surface with four distinct playing fields, each is equal to one quadrant of 64 sections. On this field is placed a standard compliment of thirty-two chess pieces. But, they are placed in a rail-fence configuration within the outer two concentric rings, as illustrated in FIG. 1 of the drawings, this very effectively spreads each players pieces over two quadrants.

To play the said game, both players must decide which of the three versions of the game to play. Upon making this decision, play may begin.

If you both have agreed upon the Single-Quad Rule, then the pieces are limited to movement within the Quadrant in which the piece began play. This automatically arouses the question of piece interaction. The question being, if a piece must remain within the quadrant in which it began play then how does one capture the opponents piece? The answer is relatively simple, if one imagines the game as multi-leveled, as in the Tri-Level chess game, except that all levels are upon the same plane. Capture is made by moving the aggressor piece to the space representing the space the victimized piece occupies in the other quadrant, thus, capture is made, as long as the move adheres to the standard rules of the game.

If both decide upon the Bi-Quad Rule, the same rules apply as in the aforementioned rule, except, that the pieces have broader range in that they can occupy, and move to either of the two quadrants their color occupied at the first of the game. White stays within either quadrant 1 or Quadrant 2, while black can occupy spaces in Quadrants three or four.

If both agree upon the Four-Quad Rule, then the same rules apply as above mentioned, except, that movement of pieces is allowed within all four quadrants of the board. In this mode one may capture by direct or indirect means, that is, by moving directly to the space occupied by the opposing piece, or by moving to a space on any of the other three quadrants that represents that space.

The next step is to establish for you a method for recording piece movement on the radial board. This is relatively simple, if we use a three numeral code system preceded by the abbreviation of the piece to be moved.

The first numeral after the abbreviated piece name indicates the quadrant in which we are to move to or within. The second numeral indicate the row in which the piece will be after the move. The third numeral indicates the column where the piece will be after the move.

An example being: P - K4 in standard notation, would look like this in Quad Notation:

Single-Quad = P - 145 (22)

Bi-Quad = P - 145 (22) or P - 245 (23)

Four-Quad = P - 145 (22) or P - 245 (23) or P - 345 (24) or P - 445 (25)

A white pawn rests at 245 (23), while a black pawn is on 454 (26). To capture, in Single-Quad, Whites turn to move: White moves to 254 (4). Since this is representative of space 454 (26), then capture is made and the black pawn is removed from the board.

This is a brief summary of the method of playing Quad-Radial Chess. This is a game for the advanced chess player. It is assumed that he or she is familiar with all aspects of the traditional game and hopefully has had experience on the Tri-Level version. So, that all reference to these games will be quickly understood without more detailed explanation.

BRIEF DESCRIPTION OF THE DRAWINGS

The FIGURE shows a plane view of the board game of the present invention.

DETAILED DESCRIPTION OF THE INVENTION

Figure 1:
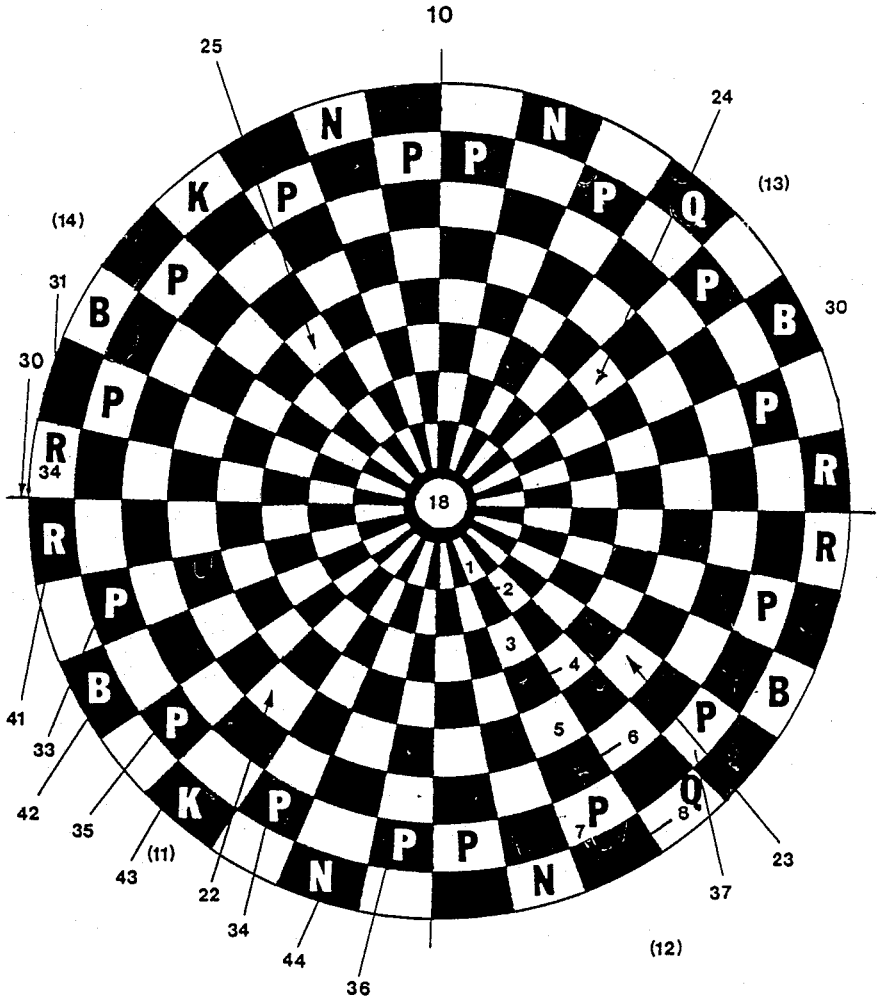

Referring now more specifically to the drawings, the numeral 10 generally designates the gameboard of the present invention. The gameboard is substantially circular and defines a central, neutral zone 18 with 32 sectors project outward, in eight concentric sections 1,2,3,4,5,6,7, and 8 to the perimeter. These sections are of alternating colors from dark to light and light to dark 31 and 34 respectively as the pattern projects outward and around the central zone 18. adjacent sections are of opposite colors, and are seperated by this distinction in coloration 31,34. These sections 1,2,3,4,5,6,7,8 are projecting from the center zone 18 with ever increasing size. It may be seen that said pattern may be affixed in numerous manner to a variety of surfaces and sizes to form the said invention.

With the attentioned focus more specifically on FIG. 1, it may be seen that a set of 32 chess pieces, in which 16 are light in color and 16 are dark, are placed upon the board 10 in a zig-zag, rail-fenced manner, within the concentric sections of the outer two rings 7,8. This configuration is totally in phase with the traditional alignment, as found within the traditional game, even if it may appear odd at first glance, with the two Knights on what appears to be the inside.

The game is played in the same manner as the traditional game of chess with the same rules as the traditional game, except that the quadrant 11,12,13,14 in which a piece can move is limited by which mode of play is agreed upon before play begins. For there are three distinct modes of play.

The first of these three modes is called the Single-Quad Rule, which the pieces are restricted to play within the quadrant in which they begin play. As an example, Whites four Royal pieces 41,42,43,44 and pawns 33,38,35,36 are restricted to Quadrant 1 (11).

The second of these modes is called Bi-Quad Rule, in which the pieces are restricted to play within his colors quadrants. An example of this mode of play is as follows: the light pieces are restricted to move within Quadrants 1 and 2 (11,12). This means that a piece from Quadrant 1 (11) may move to any space, adherent to the standard rules for piece movement, within Quadrant 1 (11) or 2 (12), or visa versa, but not cross the Center Reference Line 30 on the gameboard 10 into the domain of the dark pieces.

The last of the three modes of play is called the Four Quad Rule. It allows a piece to move freely within all four quadrants 11,12,13,14. This freedom of movement allows for more options in camouflaging the method of attacking the opponents King. Allowing freedom to attack in all areas of the field of play 10.

The only method of the game not set forth is the method by which movement of pieces are recorded for posterity. This entails the use of a system of numeration equivalent to the position of said pieces in relation to their destination. This is attained through the use of a three numeral code sequence preceded by the abbreviated form used to describe the piece you are to move. An example being: White wishes to move his King Pawn to King 4 (traditional notation), so in the Single-Quad game the move would be notated as P - 245 (23). This simply means the King Pawn 37 is moved within Quadrant 2 (12) to Row 4 of column 5.

Therefore, the invention is a new and improved version of the game of chess, from gameboard 10, to method of play. And should be viewed as an advancement in the game to be enjoyed by the player who is ready to venture out to explore the vast new world of Quad-Radial Chess.

The aforementioned is considered as illustrative only of the principles of the invention. Further, since numerous modifications and changes will readily occur to those skills in the art, it is not desired to limit the invention to the exact construction and operation shown and described, and accordingly, all suitable modifications and equivalents may be resorted to, falling within the scope of the invention.

What is claimed as new is as follows:

1. A method of playing a board game comprising of:

providing a flat, two dimensional circular game board surface, said game board surface being subdivided into four equally sized quadrants, a first quadrant, a second quadrant, a third quadrant, and a fourth quadrant, wherein each quadrant defines a chess board surface, each of said chess board surfaces being subdivided into eight discrete spaces of two alternating colors on a side providing eight ranks and files, such that said circular game board surface defines eight concentric rings of spaces, providing a plurality of chess pieces being divided into distinguishable first and second groups, one group for each player, each group having eight royal chess pieces and eight pawns, placing four royal chess pieces and four pawns of said first group in every second space of the two outermost concentric rings in said first quadrant, placing the other four royal pieces and the other four pawns of said first group in every second space of the two outermost concentric rings in said second quadrant, placing four royal chess pieces and four pawns of said second group in every second space of the two outermost concentric rings in said third quadrant, placing the other four royal chess pieces and the other four pawns of said second group in every second space of the two outermost rings in said fourth quadrant, placing, in all four quadrants, the rooks on the far-most outside file and rank, at the ninety degree and two hundred and seventy degree sides of the four quadrants to form a rail-fence pattern of chess pieces around the board, and moving said chess pieces on the spaces within said quadrants.

2. The method of claim 1, further comprising the step of:

limiting piece movement of said first group of chess pieces to the quadrant in which the piece started play and, limiting piece movement of the said second group of chess pieces to the quadrant in which it began play.

3. The method of claim 1, further comprising the step of:

limiting the movement of said first group of chess pieces to the spaces within said first and second quadrants and, limiting the movement of said second group of chess pieces to the spaces within the third and fourth quadrants.

4. The method of claim 1, further comprising the step of:

moving said chess pieces into any of said four quadrants.

5. The method of claims 1,2,3, or 4, further comprising the method step of:

capturing an opposing chess piece by moving a chess piece within a quadrant to a space having the same rank and file as a space being occupied by said opposing chess piece on any of said quadrants, removing said opposing chess piece from the game board.

6. The method of claim 1, 2, 3, or 4 further comprising the step of:

recording chess piece movement upon said board game surface to indicate moves made within a quadrant, and moves from quadrant to quadrant.

7. The method of claim 6, wherein the recording of chess piece movement comprises the step of:

indicating, with the alphabetic representation of the chess piece to be moved, indicating numerically the position of the space the chess piece is to be moved to in a three code numeral sequence the quadrant, rank, and file of said space.

* * * * *